COIN BOX SIGNALING ARRANGEMENT

BACKGROUND OF THE INVENTION

1. Field of the Invention

This invention relates to arrangements for determining when the cash receptacle of a coin-operated device is filled to a predetermined level and more particularly to arrangements for signaling a central location when the fill in coin boxes of coin telephone stations reaches predetermined levels.

2. Description of the Prior Art

One of the most important maintenance problems associated with coin-operated devices that are placed in public locations is the scheduling of coin collections, since most common coin-operated devices contain a cash receptacle or coin box which is removed from the device and emptied periodically by a coin collector. The scheduling problem is particularly important to the telephone industry which maintains many coin-operated telephone stations, each requiring periodic collections. In the past, the usual way of determining when the coin boxes were to be emptied was to base collection intervals on extrapolations of previous records. However, it became apparent that such extrapolations were inaccurate and resulted in customer dissatisfaction because the coin boxes often became overfull and interfered with coin returns during the operation of the coin station. In addition, coin collectors were frequently dispatched to make a collection when a coin box was only partially full, resulting in a waste of time and money for the telephone company.

In an attempt to circumvent these problems, many signaling arrangements have been developed. One such arrangement utilized an oscillator at the coin telephone station. The oscillator was enabled by a mechanical probe which was pushed into operating position by an accumulating stack of coins in the coin box. When the coin stack reached a predetermined height, the oscillator was enabled. Subsequently, when a coin collect potential was received from a telephone central office, the oscillator operated to place a tone burst on the telephone line, which burst was received by a central location to indicate that a coin collection should be scheduled for the station.

One problem with the above oscillator arrangement is that the time length of the tone burst produced by the oscillator must be relatively long. The long tone burst is required by the operation of the coin station. During normal operation, the coin station line is disconnected from the central office when a coin collect potential is applied to the line. Thus, the tone oscillator associated with the coin fill detector must apply a tone signal to the station line until the line has been reconnected to the central office following the disconnection of the line upon application of the coin collect potential. The length of time during which the station is disconnected from the central office varies according to station location and the operation of the equipment at the central office. Therefore, the length of the tone burst required is relatively long to accommodate worst case conditions. Since the tone burst can be heard by the customer, it is often annoying and results in customer dissatisfaction.

Accordingly, it is one object of this invention to improve the efficiency of coin collection from coin-operated devices.

It is another object of the invention to signal a remote location that the cash receptacle in a coin-operated device is filled to a predetermined height.

It is a further object of the invention to control a signal generator located at the station so that a relatively short tone burst is required to inform a central location that a coin collection should be scheduled.

SUMMARY OF THE INVENTION

These and other objects of the invention are achieved in accordance with one illustrative embodiment thereof wherein a tone generator located in the coin-operated device is controlled by a logic gate which has three inputs. A first input of the logic gate is enabled when the coin fill in the cash receptacle of the device reaches a predetermined level. A second input of the logic gate is enabled by circuitry which responds to a first signal received over an associated transmission line. The third input of the logic gate is enabled by a circuitry which responds to a second signal received over the transmission line, and the logic gate thereupon operates the tone oscillator to generate a tone signal, indicating that the cash receptacle is full.

According to a feature of the invention, the circuitry for enabling the second gate input comprises a memory device and circuitry which responds to the first signal for placing the memory device into a predetermined state to enable the second gate input. In addition, circuitry operated by the actuation of the oscillator is provided to disable the second input of the logic gate after a predetermined time interval. This circuitry allows the tone burst length to be controlled at the device and avoids overly long tone bursts.

According to one aspect of the invention, the coin fill level apparatus is utilized in a coin telephone station and a memory device is provided, which memory device is placed into a predetermined state to enable the second gate input by circuitry which responds to a coin collect potential received by the station. In addition, the third gate input is enabled by circuitry which responds to central office battery applied to an associated telephone line.

In accordance with another aspect of the invention, the coin telephone station has a coin box containing a coin probe. The coin probe enables one input of an AND gate when the coin fill reaches a predetermined level. Another input of the AND gate is enabled by a flip-flop which is set by a differentiator when a coin collect potential is received by the station. The third input of the AND gate is enabled by an inverter when battery voltage is reapplied to the associated telephone line after application of the coin collect potential. The AND gate thereupon operates a tone oscillator at the station, which oscillator sends a tone signal to a central location to indicate that the coin box is full. A delay circuit operated by the actuation of the oscillator resets this flip-flop after a predetermined time interval to disable the AND gate and the oscillator.

Advantageously, it is a feature of the invention that the tone oscillator at the coin station is not actuated until the station is reconnected to the central office after a coin collect potential has been received. The length of the tone burst may be then relatively short and still meet worst case conditions at the central office.

BRIEF DESCRIPTION OF THE DRAWING

A single sheet drawing illustrates in schematic form the logic circuit located in the telephone station which

COMPOSITE STEREOPHONIC SIGNAL GENERATOR

Figure 1:
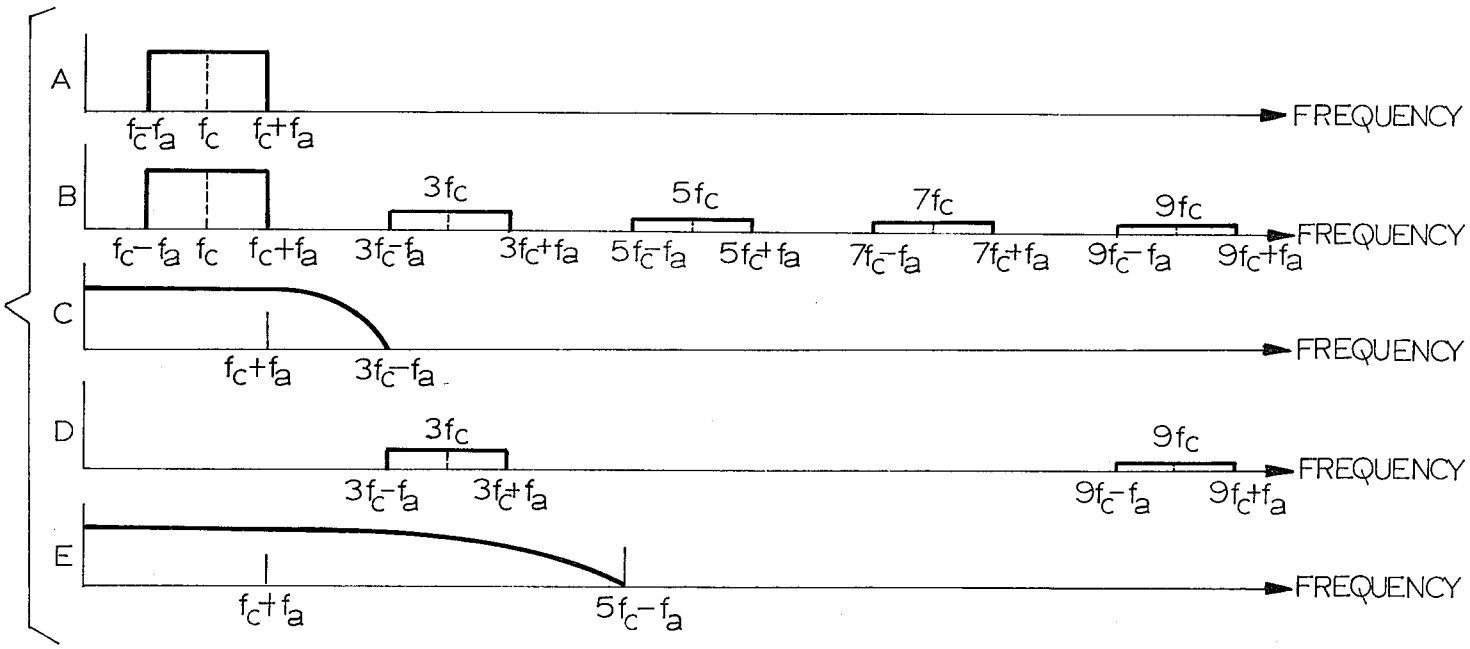

This application is a continuation-in-part of U.S. patent application Ser. No. 428,732 filed Dec. 27, 1973, now abandoned.

This invention relates to a stereophonic signal generator for generating a composite signal and attenuating undesired spurious signals in a modulated signal, e.g., in a stereophonic signal produced by a stereophonic signal generator.

A stereophonic composite signal such as the Dorren quadraplex composite signal (see U.S. Pat. No. 3,822,365) is a kind of amplitude modulated signal and is produced by a stereophonic signal generator. Such stereophonic composite signal includes a main channel signal, at least one subsidiary channel signal, and at least one pilot signal. Recently stereophonic signal generators have been put into practical use for, e.g., broadcasting of stereophonic sounds and measurement or adjustment of stereophonic receivers.

In practice, however, a stereophonic signal generator generates not only necessary composite signals, but also many spurious signals caused mainly by modulation distortion of subsidiary channels. These spurious signals so often cause spurious radiation and irregular measurement or adjustment that they must be sufficiently attenuated by some means. For doing so, low pass filters or band pass filters have been conventionally used, but such filters are apt to degrade amplitude characteristics and phase characteristics in the frequency band of the necessary signals when the cut off frequency of the filter which is used is near the end of the frequency band of the necessary signals. On the other hand, when the cut off frequency of the filter which is used is chosen so as to be far from the end of the frequency band of the necessary signals, such degradation of amplitude and phase characteristics can be avoided, but spurious signals cannot be sufficiently attenuated.

Generally, in suppressed-carrier-amplitude-modulation, it is more suitable to use, as a carrier signal, a rectangular wave than a sine wave because of considerations of stability, reliability and quality of the modulated signals. Such a rectangular carrier wave, however, has many harmonic components which are integral multiple overtones of the fundamental frequency. Thus, when the rectangular wave is modulated by input signals, there are produced many spurious harmonic double sideband signals with integral multiple overtones of the fundamental frequency as their centers. Hence, the generation of such spurious signals is practically inevitable as long as rectangular waves are used. Meanwhile, the ratio of the lowest frequency of a signal to be attenuated to the highest frequency of a signal to be passed is a very imporatant factor in designing low pass filters. This ratio is defined as a "cut off frequency ratio" in this application. When the cut off frequency ratio is close to 1, the design of filters is extremely difficult. Thus, some suitable method for effectively eliminating spurious signals in such a case has been required.

Accordingly, it is an object of this invention to provide a stereophonic signal generator which generates a composite signal in which undesired spurious signals are effectively attenuated, e.g., an FM broadcasting signal, a measurement signal or a signal for adjustment of stereophonic receivers, etc. This object is achieved according to this invention by a signal generator which has means for generating a cancellation signal occupying a cancellation frequency band and corresponding at least to a main spurious signal which is one of the spurious signals and is the most closely adjacent to the given or desired frequency band of necessary signals among the spurious signals; means for combining the cancellation signal with the modulated signal so as to achieve, in the cancellation frequency band, spurious signal cancellation including cancellation of the main spurious signal; and attenuating means remaining spurious signals, e.g. at least one filter. According to this invention, spurious signals in a modulated signal can be effectively and sufficiently attenuated without degrading the amplitude and phase characteristics of the necessary signals in the modulated signal. In a stereophonic signal generator according to the invention, excellent characteristics of channel separation can be obtained thereby.

Figure 2:
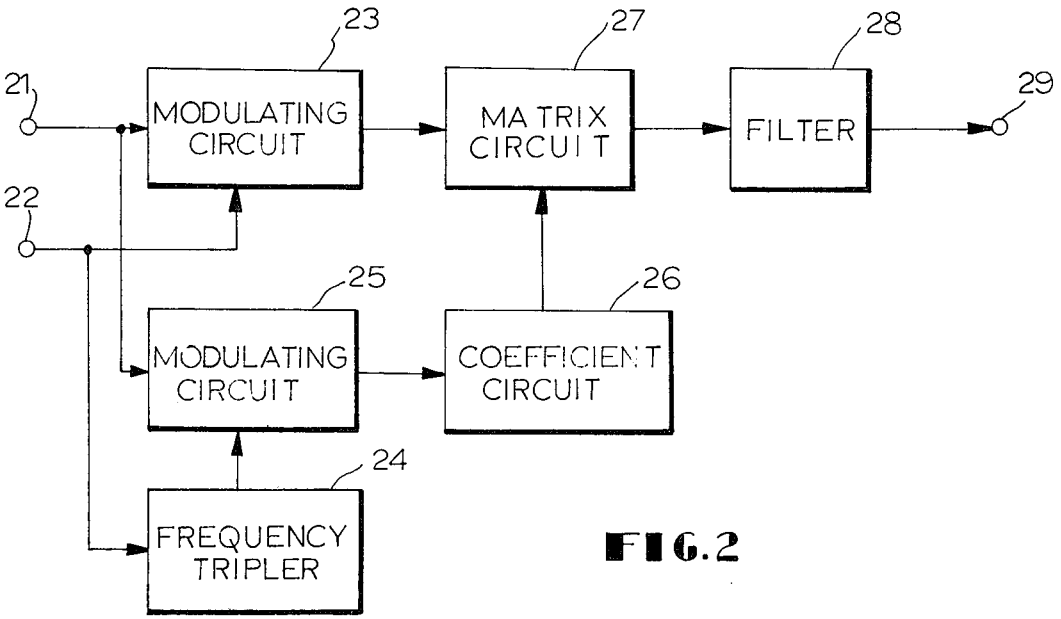
Figure 3:
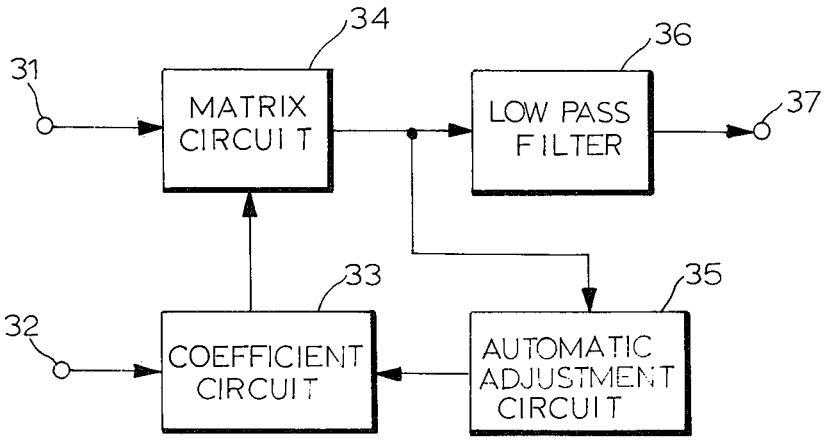
Figure 3:
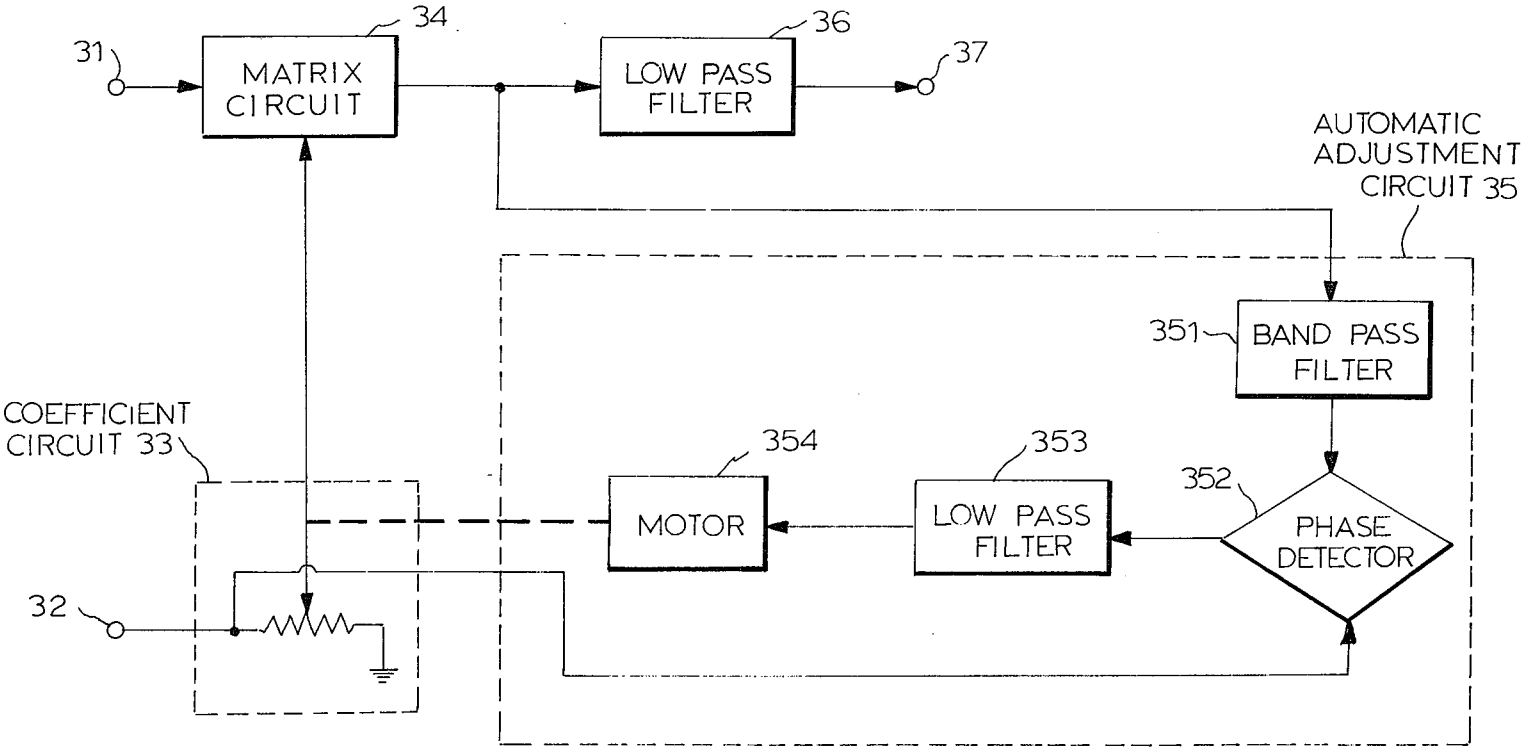
Figure 4:
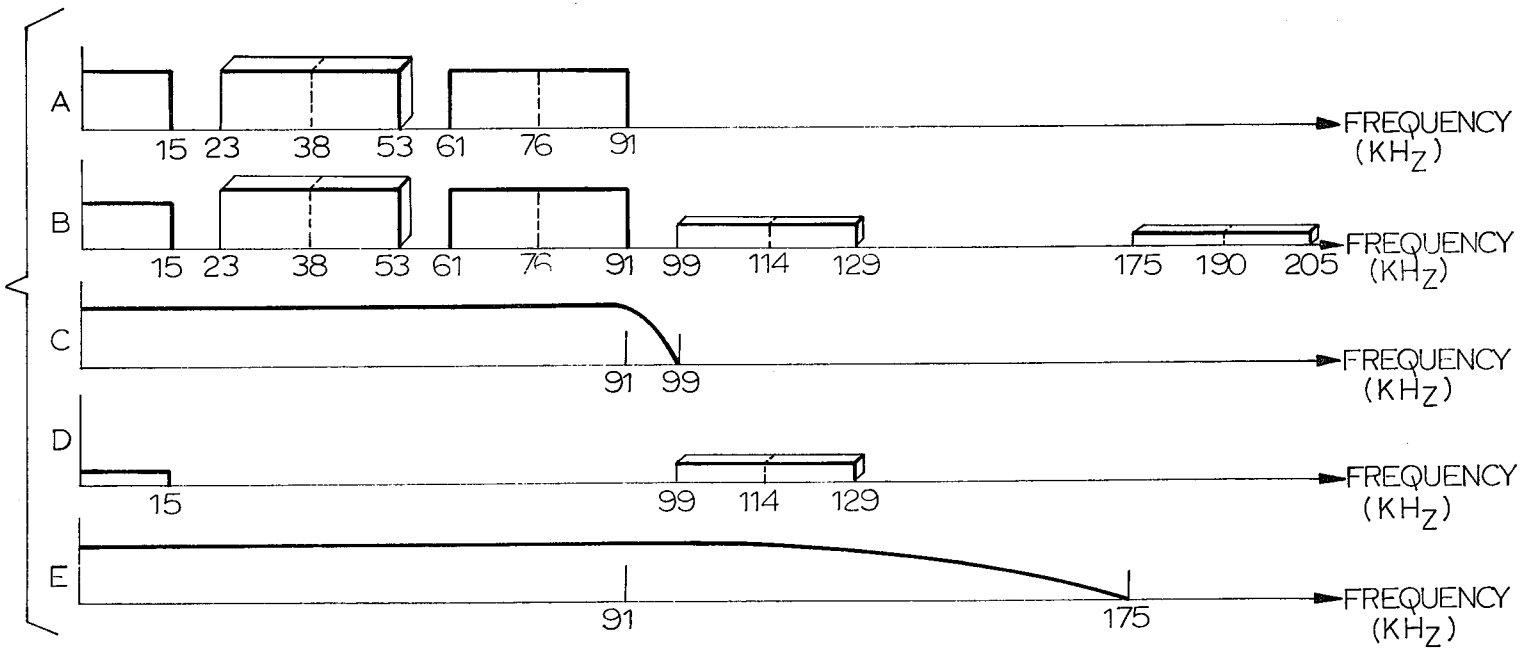
Figure 5:
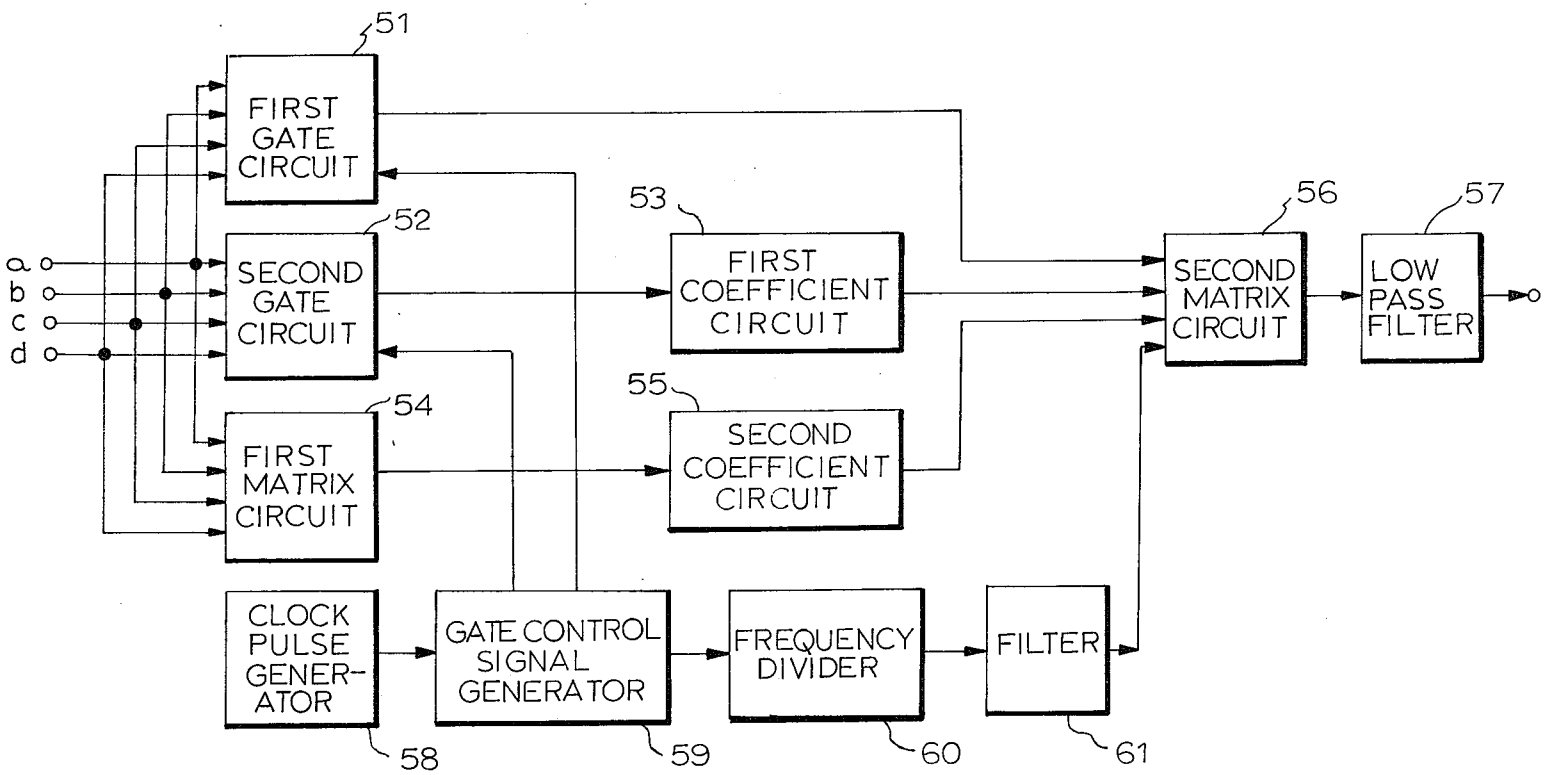
Figure 6:
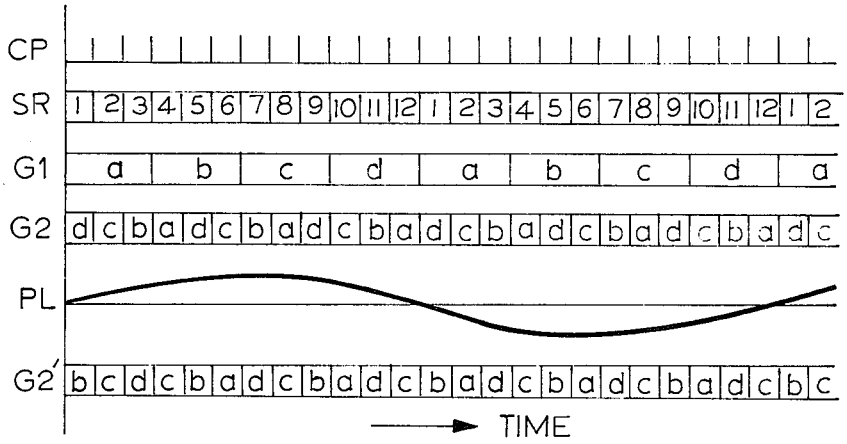

These and other features of this invention will be apparent from the following detailed descriptions, taken together with the accompanying drawings, in which:

FIG. 1 is a graph showing frequency spectra and frequency responses of filters;

FIG. 2 is a schematic diagram in block form of a circuit showing the typical generator of this invention;

FIG. 3 is a fragmentary schematic diagram in block form of a circuit for automatic coefficient adjustment used for the generator of this invention;

FIG. 3' is a circuit diagram of a specific circuit for automatic coefficient adjustment;

FIG. 4 is a graph showing frequency spectra and frequency responses of filters;

FIG. 5 is a schematic diagram in block form of a four channel stereophonic signal generator for generating a stereophonic signal according to this invention; and FIG. 6 is a time chart illustrating the operation of the four channel stereophonic signal generator of FIG. 5.

The typical operation of the generator of this invention can be seen from FIGS. 1 and 2, wherein FIG. 1 is a graph showing frequency spectra and frequency responses of filters, and FIG. 2 is a schematic diagram in block form of a circuit for generating a signal according to this invention.

Referring to FIG. 1, part A represents a frequency spectrum of an ideal suppressed carrier amplitude modulated wave where a modulating signal having a frequency limited to the frequency band of from 50 Hz to $f_a$ modulates a carrier of the frequency $f_c$. In practice, even a well-tuned doubly balanced modulator produces many spurious signals besides the necessary (desired) signal as shown by part B in FIG. 1. In order to attenuate the spurious signals, a low pass filter or a band pass filter is required, which attenuates the spurious signals sufficiently without departing the quality of the necessary signal no matter how much the cut off frequency ratio thereof is. In this case, the cut off frequency ratio, which is $(3f_c-f_a):(f_c+f_a)$, is close to 1, and it is usually almost impossible to obtain such a filter (e.g., having a frequency response curve as shown by part C in FIG. 1). The technical concept of this invention is directed to a novel solution for solving this problem.

Referring to FIG. 2, reference numerals 21 and 22 designate input terminals for a modulating signal and a carrier, respectively. They are applied to a modulating circuit 23 which produces many spurious signals outside the necessary signal as shown in part B in FIG. 1. In FIG. 2, the remaining blocks are newly employed elements.

In a modulating circuit 25, a carrier which comes from the carrier input terminal 22 through a frequency tripler 24 is modulated by a modulating signal which comes from the modulating signal input terminal 21. The output signal of the modulating circuit 25, i.e., a modulated signal, is multiplied by a coefficient in a coefficient circuit 26, and the thus multiplied signal is applied to a matrix circuit 27, where the multiplied signal is combined with the output of the modulating circuit 23, i.e., a modulated signal. The above said coefficient is dependent on the sign and level of the modulated signal from the modulating circuit 25, and the coefficient is adjusted to cancel a main spurious signal which is the spurious signal among all the spurious signals which is most closely adjacent to the necessary (desired) signal. Of course, such spurious signal cancellation is not necessarily limited to the cancellation of only the main spurious signal, and the spurious signal which is the second most closely adjacent to the necessary signal can be cancelled simultaneously with the cancellation of the main spurious signal. In this application, the word "cancellation" means not only an ideal or total cancellation, but also a practical or substantially total cancellation, i.e., one which does not cancel a purious signal 100%. The output signal from the modulating circuit 25 or the output signal derived from the coefficient circuit 26 can be called a cancellation signal. It can be said that by the generator according to this invention, a cancellation signal occupying a cancellation frequency band and corresponding at least to the main spurious signal is generated, and the cancellation signal is combined with the modulated signal containing spurious signal to be eliminated so as to achieve, in the cancellation frequency band, spurious signal cancellation including cancellation of the main spurious signal. The manner of combining the cancellation signal with the modulated signal can be carried out by using the matrix circuit 27 which, for performing the cancellation, adds the cancellation signal to the modulated signal when the sign of the cancellation signal is nagative, or subtracts the component of the cancellation signal from the modulated signal when the sign of the cancellation signal is positive. There are two known techniques to produce a stereophonic composite signal. One technique is to first compose, from input audio signals, a main channel signal component and sub-channel signal components individually, and then combine these signal components into a stereophonic composite signal. This technique is called frequency division. The other technique is to gate input audio signals in a predetermined sequence so as to compose a main channel signal component and sub-channel signal components at the same time. This technique is called time division. Details of the time division type will be described later. In supplying carriers to the modulating circuits 23 and 25 for generating the modulated signal and the cancellation signal, carriers which are derived from a single signal source can be used.

Now, referring to part D in FIG. 1, it shows a graph of frequency spectrum of the output signal of the coefficient circuit 26 when properly adjusted. As the result of the adjustment, the main spurious signal is no longer included in the output signal of the matrix circuit 27, so the cut off frequency ratio becomes far from 1, and the residual spurious signals, if any, can be easily attenuated by at least one filter 28 (e.g., a filter the response of which is as shown in part E in FIG. 1), without degrading the desired signal. Reference numeral 29 designates an output terminal. Here, the coefficient circuit is shown as an independent element for the purpose of illustration only, but the concept of this invention can be maintained without such a coefficient circuit when the level and the polarity are adjusted in the modulating circuit 25 or in the matrix circuit 27. Further, instead of using the frequency tripler, phase-lock-loop techniques can be used. Also, a $\frac{1}{3}$ frequency divider can be used therefor. Of course, in using the frequency divider, the modulating circuit 25 is directly connected to the input terminal 22, and the frequency divider is connected between the input terminal 22 and the modulating circuit 23, and the carrier to the input terminal 22 should have a frequency three times higher than that in the case of using the frequency tripler. If further additional circuits (e.g., additional circuits similar to the frequency tripler 24, the modulating circuit 25 and the coefficient circuit 26) are employed, the spurious signals with still higher overtones as their centers can be cancelled in a manner similar to that described above, and the cut off frequency ratio moves still farther from 1, so that the residual signals can be more easily and more sufficiently attenuated with still less degradation of the desired signal. Furthermore, spurious signals with even multiple overtones as their centers also can be reduced, thereby by slightly changing the multiplying factor of the frequency multiplier and coefficient circuit.

The above-described adjustment of the coefficient is often very critical ad is apt to shift under the influence of temperature or aging. A fragmentary schematic diagram in block form of a circuit for automatic coefficient adjustment is shown in FIG. 3. Reference numerals 31 and 32 designate input terminals of a matrix circuit 34 and a coefficient circuit 33, which correspond to the matrix circuit 27 and the coefficient circuit 26 in FIG. 2, respectively. Reference numerals 31 and 32 designate input terminals of a matrix circuit 34 and a coefficient circuit 33 which correspond to the matrix circuit 27 and the coefficient circuit 26 in FIG. 2, respectively. Reference numerals 36 and 37 designate a low pass filter and its output terminal corresponding to the low pass filter 28 and the output terminal 29 thereof in FIG. 2, respectively.

An automatic adjustment circuit 35 detects signals in the frequency range of the spurious signal to be cancelled (cancellation frequency band), and the output signal of the automatic adjustment circuit 35 is applied to the coefficient circuit 33, where the coefficient is adjusted by the output signal of the automatic adjustment circuit 35 for optimum cancellation. Blocks 33, 34 and 35 and their connections compose a feedback loop. The method of the automatic adjustment per se can be any available and suitable method. For example, a perturbation method which is well-known in automatic control technology can be used, in which a variable of a function is perturbed so as to keep the variable at a value to make the function optimum as much as possible. This method is generally called "least-square optimization" (see Sheldon S. L. Chang: *Synthesis of Optimum Control Systems,* Chapter 2, McGraw-Hill Book Company, Inc., 1961). In this case, the coefficient is the variable and the degree of the cancellation is the function.

A more specific circuit for automatic coefficient adjustment, well-known to one of ordinary skill in the art, will be described below with reference to FIG. 3'. Referring to FIG. 3', an undesired spurious signal contained in the output signal of the matrix circuit 34 is extracted by a band pass filter 351, and is compared in regards to phase, by a phase detector 352, with the cancellation signal applied to the input of the coefficient circuit 33. In FIG. 3', the coefficient circuit comprises a potentiometer. When the coefficient of the coefficient circuit 33 is large, the phase detector 352 shows that the phase of the two inputs thereto are the same, whereas when the coefficient of the coefficient circuit 33 is small, the phase detector 352 shows that the phases of the two inputs are opposite each other. That is, the direct current component in the output of the phase detector becomes plus or minus, depending on the coefficient of the coefficient circuit 33. Therefore, by extracting the direct current component in the outut of the phase detector 352 by using a low pass filter 353, and by driving a motor 354 by the thus obtained direct current component, the coefficient of the coefficient circuit 33 (i.e., the resistance of the potentiometer coupled to the moter 354) can be varied. By such a feedback loop, the coefficient of the coefficient circuit can be adjusted so that it becomes the optimum.

The concept of this invention described in the above typical embodiments can be directly applied to the modulations of subsidiary channels of multichannel stereophonic signal generators. In such generators, each subsidiary channel signal can be produced as above described.

Hereinbefore, operations and effects of the typical embodiments of the frequency division type have been described. But the concept of this invention can also be applied to an arrangement of the time division type, as follows.

For illustrating a typical arrangement of the time division type using the concept of this invention, an arrangement of a four channel stereophonic signal generator which can generate a Dorren quadraplex composite signal will be described hereinafter with reference to FIGS. 4, 5 and 6. FIG. 4 is a graph showing frequency spectra and frequency responses of filters. FIG. 5 is a schematic diagram in block form of a four channel stereophonic signal generator according to this invention. FIG. 6 is a time chart illustrating the operation of the four channel stereophonic signal generator of FIG. 5.

Referring to FIG. 4, a frequency spectrum of a four channel stereophonic composite signal is shown in part A in FIG. 4. The composite signal comprises a main channel signal of audio frequency, two orthogonal subsidiary channel signals with a suppressed carrier of 38 kHz as their centers, a third subsidiary channel signal with a suppressed carrier of 76 kHz as its center, and one or a plurality of pilot signals. The pilot signals are not shown in FIG. 4 for the purpose of simplification. An ordinary time divisional signal generator produces such a frequency spectrum as shown in B in FIG. 4. The spectrum as shown in B has two problems. One is the level difference between the main channel and the subsidiary channels, and the other is the inclusion of many spurious signals. The former problem can be solved easily by means of some matrix circuits, but the latter problem is difficult because the upper limit of the frequency band of a four channel stereophonic composite signal is 91 kHz and there are two orthogonal spurious signals too close to the third subsidiary channel to be attenuated by ordinary filters. If a filter with a steep frequency response curve at the cutoff frequency as shown in C in FIG. 4 were available, the latter problem would not be so serious, but such a filter with a steep frequency response curve at the cutoff frequency is not readily available.

In accordance with the concept of this invention, the spurious signals with 114 kHz as their centers can be cancelled by such signals as shown in part D in FIG. 4. In this example, the signals are produced by a time divisional method, but a frequency divisional method can also be used therefor. The signals as shown in part D are produced at a gating rate three times that for the signals of part B with a sequence the details of which are described later with reference to FIG. 6, and are adjusted so as to be at the same level as the signals with 114 kHz as their centers. As a result of the combination of signals as shown in part D with signals as shown in part B in FIG. 4, the main spurious signals are cancelled, and the lowest frequency of the residual suprious signals is 176 kHz, and these can be easily attenuated by an ordinary filter, the frequency response of which is as shown in part E in FIG. 4, without any degradation of the desired signals. Comparing the frequency responses of parts C and E, the effect of this invention is considered to be easily understood.

More detailed features of this invention will be described hereinafter with reference to FIGS. 5 and 6.

Referring to FIG. 5, symbols *a, b, c* and *d* designate four channel input signals, respectively, and the upper limit of the frequency band of these input signals is 15 kHz and all of them are applied to a first gate circuit 51, second gate circuit 52 and a first matrix circuit 54. These gate circuits are controlled by a gate control signal generator 59 which is driven by a clock pulse generator 58. One of the output signals of the gate control signal generator 59 is applied to a frequency divider 60, the output signal of which is shaped into a sine wave through a filter 61. The output signals of the second gate circuit 52 and the first matrix circuit 54 are applied to first and second coefficient circuits 53 and 55, respectively. All of the output signals of the first gate circuit 51, the first coefficient circuit 53, the second coefficient circuit 55, and the filter 61 are applied to a second matrix circuit 56, the output signal of which is obtained as a four channel stereophonic composite signal through a low pass filter 57.

Referring to FIG. 6, the operation of the gate circuits 51 and 52, and the phase of a pilot signal are shown. The clock pulse generator 58 produces clock pulses at 456,000 pulses per second as shown in CP in FIG. 6. The gate control signal generator 59 comprises 12 stages of shift registers and eight three-input-OR circuits. One of the states of the 12 shift registers is always logical 1, and the others are always logical 0. The stage which is in the state of logical 1 is sequentially rotated one stage by one clock pulse. The reference numerals in SR in FIG. 6 designate the number of the stage which is logical 1. Symbol G1 designates the gating operation of the first gate circuit 51, where the input signal *a* is passed when one of the states of the first, second and third stages of the shift register is logical 1, and similarly *b* for one of the states of the fourth, fifth and sixth stages, and so on. When the gating operation has successively gated all of the input signals it has made one sequential rotation, and the frequency of the rotation of the sequence is the number of such rotations in 1 second. When there are $38 \times 10^3$ such rotations per second in the gating operation of the first gate circuit 51, the output signal of the first gate circuit 51 can be expressed by the following formula (1):

$$\frac{1}{4}(a + b + c + d) \qquad (1)$$

-continued

: component of main channel signal $$+\frac{1}{\pi}(a+b-c-d)\sin\omega t$$

: component of first subsidiary channel signal $$+\frac{1}{\pi}(a-b-c+d)\cos\omega t$$

: component of second subsidiary channel signal $$+\frac{1}{\pi}(a-b+c-d)\sin 2\omega t$$

: component of third subsidiary channel signal $$+\frac{1}{3}\pi(a+b-c-d)\sin 3\omega t$$

: adjacent spurious signal $$+\frac{1}{3}\pi(-a+b+c-d)\cos 3\omega t$$

:adjacent spurious signal $$+\frac{1}{5}\pi(a+b-c-d)\sin 5\omega t$$

:spurious signal $$+\frac{1}{5}\pi(a-b-c+d)\cos 5\omega t$$

: spurious signal $$+\ldots\ldots$$

where $\omega=2\pi\times38\times10^3$ radians/second. According to the concept of this invention, at least the fifth and sixth terms of the above formula (1) are cancelled by spurious signal cancellation.

Symbol G2 in FIG. 6 designates the operation of the second gate circuit 52, where the input signal $a$ is passed when one of the states of the fourth, eighth and twelfth stages of the shift register is logical 1, and similarly $b$ for one of the states of the third, seventh and eleventh stages, and so on. And the output signal of the second gate circuit 52 is applied to the first coefficient circuit 53, where the level of the signal is multiplied by $\frac{1}{3}$. As a result of this operation, the output signal of the first coefficient circuit 53 can be expressed by the following formula (2):

$$\begin{aligned}&\frac{1}{12}(a+b+c+d)\\&+\frac{1}{3}\pi(-a-b+c+d)\sin 3\omega t\\&+\frac{1}{3}\pi(a-b-c+d)\cos 3\omega t\\&+\frac{1}{3}\pi(-a+b-c+d)\sin 6\omega t\\&+\ldots\ldots\end{aligned}\tag{2}$$

Therefore, the summation of the output signals of the first gate circuit 51 and the first coefficient circuit 53 can be shown in the formula as follows:

$$\begin{aligned}&\frac{1}{3}(a+b+c+d)\\&+\frac{1}{\pi}(a+b-c-d)\sin\omega t\\&+\frac{1}{\pi}(a-b-c+d)\cos\omega t\\&+\frac{1}{\pi}(a-b+c-d)\sin 2\omega t\\&+\frac{1}{5}\pi(a+b-c-d)\sin 5\omega t\\&+\frac{1}{5}\pi(a-b-c+d)\cos 5\omega t\\&+\ldots\ldots\end{aligned}\tag{3}$$

There remain no adjacent spurious signals in the formula (3), but there remains little level difference between the main and the subsidiary channels. The first matrix circuit 54 sums all the input signals and its output signal, i.e., $a+b+c+d$ is applied to the second coefficient circuit 55 where the signal is multiplied by $(1/\pi-1/3)$ in order to compensate for the level difference. Hereinabove, the cancellation by addition has been described. However, it is clear that cancellation by subtraction can be similarly used. When cancellation by subtraction is used, the order to sequence of the gating is changed to a sequence as represented by G2′ in FIG. 2, and the multiplying factor of $(1/\pi-1/6)$ is used instead of $(1/\pi=1/3)$.

Symbol PL in FIG. 6 designates a pilot signal of 19 kHz which is supplied from the filter 61.

All the output signals of the first gate circuit 51, the first coefficient circuit 53, the second coefficient circuit 55 and the filter 61 are applied to the second matrix circuit 56, where all of these signals are summed, and the summed signal is applied to the low pass filter 57 which provides the desired stereophonic composite signal, even if the frequency response of the low pass filter 57 is not steep at the cut off frequency thereof.

An experiment by the applicants of this embodiment discloses that the adjacent (main) spurious signals can be reduced to less than −40 dB, and the residual spurious signals can also be attenuated substantially completely by using the low pass filter described further below which corresponds to the filter 57 in FIG. 5. The filter comprises a series circuit of two stages of constant K-type low pass filters, the cutoff frequencies of which are at 152 kHz, two states of derived M-type low pass filters of the same cutoff frequencies, the attentuation poles of which are at 190 kHz, two stages of derived M-type low pass filters of the same cut off frequencies, the attenuation poles of which are at 228 kHz and two stages of phase compensators, the time constants of which are about $110\times10^{-6}$ second. An amplitude error less than 0.1 dB and a phase error less than 1° are obtained in the frequency range from 50 Hz to 91 kHz, and separations more than 45 dB are obtained in any combination of input signals in the frequency range from 50 Hz to 15 kHz. In comparison with conventional data which show a separation less than 20 dB for input signals in the frequency range of from 10 kHz to 15 kHz, these data are considered to be clearly superior.

The embodiment described above is a typical one for a four channel stereophonic signal generator to aid in understanding the concept of this invention and to show that the signal generator as claimed in the claims below is effective for attenuating undesired spurious signals in a modulated signal and a given frequency range. But it is clear that variations and modifications such as application of the above-described automatic adjustment, reorganization of three or multichannel signal generators, and so on may be made by one skilled in the art without departing from the spirit and scope of this invention as described in detail above.

For example, in the time chart of FIG. 6, if the signal *a* is regarded as the same signal as the signal *b* ($a=b=A$), and the signal *c* is also regarded as the same signal as the signal *d* ($c=d=B$), then the gating operation G1 in FIG. 6 can be regarded as being in a sequence A→B→A→B . . . , and the gating operation G2 can be regarded as being (B→A→B)→(A→B→A)→(B→A→B) . . . . The stereophonic (composite) signal generator thus regarded is a two-channel stereophonic (composite) signal generator. Thus, it is clear that such two-channel stereophonic signal generator is within the scope of this invention. It is a matter of course that in this case said gate control signal generator can comprise six stages of shift registers and four three-input OR circuits, and the number of clock pusles can be 456,000/2=228,000 pulses per second.

Further, when the two input signals applied to such a two-channel stereophonic signal generator have the same amplitude and phases opposite to each other, such a two-channel stereophonic signal generator can be regarded as a subsidiary channel signal generator for generating a subsidiary channel signal in a stereophonic composite signal. Accordingly, a stereophonic composite signal generator including such a subsidiary channel signal generator is also clearly within the scope of this invention.

What is claimed is:

1. A stereophonic composite signal generator for generating a stereophonic composite signal having one main channel signal, at least one double side-band subsidiary channel signal and at least one pilot signal, the generator comprising gating circuit means for gating plural input signals in rotation in a predetermined sequence and frequency and with a constant duration for each input signal so as to produce a signal corresponding to said stereophonic composite signal and spurious harmonic signals which are (1) outside the frequency band of said stereophonic composite signal, and (2) double side-band signals, the center frequencies of which are integral multiples of the frequency of the rotation of said predetermined sequence, at least one spurious harmonic signal the center frequency of which is three times higher than the frequency of the rotation of said predetermined sequence representing at least one closest spurious harmonic signal closest to said stereophonic composite signal, a single time base source being coupled to said gating circuit means for controlling the gating operation of said gating circuit means and from which said pilot signal is derived, further gating circuit means for gating said input signals in a further sequence, the reverse of said predetermined sequence of the gating operation of said first mentioned gating circuit means and with a further constant duration for each input signal, said time base source being coupled to said further gating circuit means for controlling the gating operation of said further gating circuit means, and the sum of the duration of the passages of three sequentially gated input signals through said further gating circuit means being synchronized with the duration of the passage of one input signal through said firstmentioned gating circuit means for causing the frequency of the rotation of said further sequence to be three times higher than the frequency of the rotation of said predetermined sequence so as to produce a cancellation signal having a signal component corresponding to said at least one closest spurious harmonic signal and no signal component in the frequency band of said subsidiary channel signals in said stereophonic composite signal; a coefficient circuit means coupled to said further gating circuit means for adjusting the output amplitude of said further gating circuit means; a matrix circuit means coupled to said gating circuit means and to said coefficient circuit means for combining the output signals from said gating circuit means and from said coefficient circuit means so as to cancel said at least one closest spurious harmonic signal in the output signal of said gating circuit means, and at least one filter coupled to said matrix circuit means for attenuating the remaining spurious harmonic signals, if any.

2. A stereophonic composite signal generator according to claim 1, wherein the number of said input signals is two, the number of said at least one closest spurious harmonic signal is one, said frequency of the rotation of said predetermined sequence of said gating circuit means is 38 kHz, and said frequency of the rotation of said further sequence of said further gating circuit means is 114 kHz.

3. A stereophonic composite signal generator according to claim 1, wherein the number of said input signals is four, the number of said at least one closest spurious harmonic signal is two, said frequency of the rotation of said predetermined sequence of said gating circuit means is 38 kHz, and said frequency of the rotation of said further sequence of said further gating circuit means is 114 kHz.

* * * * *